United States Patent [19]

Hilinsky

[11] Patent Number: 4,643,431

[45] Date of Patent: Feb. 17, 1987

[54] BLACKJACK BOARD GAME

[76] Inventor: David Hilinsky, 606 Orchard St., Cranford, N.J. 07016

[21] Appl. No.: 718,878

[22] Filed: Apr. 2, 1985

[51] Int. Cl.[4] ..... A63F 3/00

[52] U.S. Cl. ..... 273/243; 273/141 R

[58] Field of Search ..... 273/243, 249, 274, 261, 273/248, 268, 242, 236, 142 R

[56] References Cited

U.S. PATENT DOCUMENTS

| | | | |
|---|---|---|---|
| Re. 28,108 | 8/1974 | Lippert | 273/274 |
| 3,427,027 | 2/1969 | Kenyon | 273/243 |
| 3,826,499 | 7/1974 | Lenkoff | 273/269 X |
| 4,340,228 | 7/1982 | Robbins et al. | 273/274 X |
| 4,492,378 | 1/1985 | Williams | 273/274 X |
| 4,515,369 | 5/1985 | Johnson | 273/243 |
| 4,560,171 | 12/1985 | Anthony | 273/269 |

*Primary Examiner*—Richard C. Pinkham
*Assistant Examiner*—Matthew L. Schneider
*Attorney, Agent, or Firm*—Rohm & Monsanto

[57] ABSTRACT

A game of chance similar to blackjack is playable without a deck of blackjack playing cards. A plurality of player landing stations are provided on a game board in a predetermined sequence. Each such station has associated therewith a face value number which corresponds to the value of a pair of cards from a blackjack deck. A pair of dice is rolled initially to advance a player along the sequence of stations. In situations where the player thus advanced desires to receive the equivalent of another playing card, the dice are rolled again and the resulting numerical value is correlated probabilistically to predetermined card values. The correlated card value is then added to the base value number of the station on which the player has landed so as to provide a playing number. In embodiments where the numbers are correlated to the game of blackjack, a sum greater than 21 would be considered an immediate loss. The dealer is represented by a further game board which, in a preferred embodiment, is rotatable with a plurality of pie-shaped segments which are angularly dimensioned to correspond to the probability that the dealer would achieve a playing number 17 and 21. Thus, since the dealer is represented by a chance device, the game can be played by one or several players.

7 Claims, 2 Drawing Figures

BLACKJACK BOARD GAME

BACKGROUND OF THE INVENTION

This invention relates generally to board games, and more particularly to a blackjack board game wherein the well-known game of blackjack, which is ordinarily played with playing cards, is played on a board without the use of any playing cards.

The prior art has taken a variety of approaches toward providing board games which bear some similarity to chance games of the type which are generally played with playing cards. Generally, such board games required the use of a conventional deck of cards, and therefore the board apparatus aspect of the game serves merely as an aid in organizing the playing cards during play.

In addition to the foregoing, the prior art has provided game apparatus which serves to assist in the chance selection of selected playing card values by the spinning of a pointer indicator. One such device is described in U.S. Pat. No. 2,231,406, wherein the five high card values of each of the four suits are indicated so as to permit a pointer to land on any of such twenty card values. As shown in this patent, the card selection apparatus is essentially in the form of an ash tray and can only include selection of one of twenty possible card values. A substantial reduction in the printing on the ash tray, or enlargement of the ash tray itself, would be required if all fifty two cards of a conventional playing deck were to be represented thereon.

Blackjack is well known as being one of the most popular games. In casino play, a plurality of decks of cards, illustratively eight, are shuffled together and used by the dealer. It is a problem with playing blackjack in this manner that use of so many decks of playing cards is expensive and bulky for home use. In addition, the use of playing cards requires periodic reshuffling thereof and the possible loss or misplacement of one or more cards.

It is, therefore, an object of this invention to provide a blackjack board game which does not require the use of cards during pay.

It is another object of this invention to provide a blackjack board game which captures the essence of conventional blackjack using playing cards.

It is also an object of this invention to provide a blackjack board game which produces the effect of playing blackjack with multiple decks of playing cards.

It is additionally an object of the invention to provide a blackjack board game which is simple and inexpensive.

It is a further object of this invention to provide a blackjack board game wherein the probabilities of winning and losing correspond substantially to the game as played with playing cards.

It is yet another object of this invention to provide a blackjack board game which can be played by a single player.

It is still another object of this invention to provide a blackjack board game which eliminates card counting by a player.

it is a yet further object of this invention to provide a blackjack board game wherein the house, or the dealer, can have a probability of winning or busting which corresponds to the probability of winning or busting when the game is played with playing cards, and without the need for a player to function as the dealer.

SUMMARY OF THE INVENTION

The foregoing and other objects are achieved by this invention which provides an apparatus and a method for playing a game of chance which corresponds in its essential aspects to blackjack played with playing cards. In accordance with an apparatus aspect of the invention, a first game boards region provides a plurality of stations on which a player may land. Such stations are arranged in a predetermined sequence, so as to establish a route by which a player is advanced along the board. Additionally, each such station has associated therewith a respective base value number. A chance device of the type which generates a substantially unpredictable numerical value is operated, and a first such unpredictable numerical value is used to advance the player to a subsequent station. In situations during play where the player desired to receive the equivalent of another card, the chance device is operated again to produce a further substantially unpredictable numerical value. In a particularly advantageous embodiment of the invention, the further unpredictable numerical value is correlated probabilistically to a chance value number, which, in the preferred embodiment, corresponds to a value of a playing card. This chance value is then added to the base value number associated with the station on which the player has landed to produce a sum value for the player. As is the case with convention blackjack, the player may elect to stand on the sum value, assuming it does not have a value greater than a predetermined threshold bust value, illustratively twenty one, whereby the player is deemed immediately to have lost. However, if the sum value is less than the threshold value, and therefore is a playable value, the player may elect at that time to take his chance against the dealer or receive the equivalent of a further card, in which event, the chance device is operated again to produce a further chance value number. A second game board region is used to select a further substantially unpredictable numerical value which becomes, in essence, the dealer's hand. A winner is determined by comparison of the sum value of the player against the hand of the dealer.

In a specific illustrative embodiment of the invention, the base value numbers which are associated with respective ones of the stations of the first game board region correspond to a combination of card pairs from a blackjack card deck. Thus, for example, a station on which the player may land may be designated as four and three, signifying that the player has been dealt a four and a three, for a total of seven. Of course, certain ones of the stations are designated with two equal numbers, signifying that the player has been dealt two equally valued cards. In such a situation, the player may split his hand, as in conventional blackjack.

In a highly advantageous and economical embodiment of the invention, the chance device is a pair of dice, and therefore the probabilities of rolling certain numbers are different from the probabilities of rolling other numbers. For example, a dice value of two can be achieved by only one combination. That is, a first die must roll a value one, and a second die must also roll a value one. On the other hand, a dice value of seven can be achieved by rolling one and six, two and five, three and four, four and three, five and two, six and one. Thus, the chances of rolling a seven are greater that the chances of rolling a two, using a pair of dice.

In accordance with the invention the rolled dice values are correlated to respective specific card values in accordance with the following table:

| DICE VALUE | CORRELATED CARD VALUE |
|---|---|
| 2 | 1 or 11 |
| 3 | 1 or 11 |
| 4 | 7 |
| 5 | 5 |
| 6 | 4 |
| 7 | 10 |
| 8 | 10 |
| 9 | 9 |
| 10 | 9 |
| 11 | 2 |
| 12 | 8 |

Thus, after the player has rolled the dice so as to land at a chance-selected station, and if the player desires to be hit, as in conventional blackjack played with playing cards, the player rolls the dice again to obtain the correlated card value which is added to the card pair represented at the station where the player has landed. By using such a correlation table, the probability that a player will bust upon receiving a further card value remains roughly equivalent to the probability of busting using playing cards.

As previously indicated, the house, or dealer, is represented by a second game board region, which may, in certain embodiments, be separate from the first game board region. In one embodiment, the second game board region is provided with a segmented portion having a plurality of segment regions which are respectively dimensioned to correspond probabilistically with selected values of card combinations from a blackjack card deck. It is assumed that a dealer will always hit a sixteen or lower, and therefore this number is not represented in the specific illustrative embodiment. However, a dealer will stand on seventeen or higher. In accordance with the invention, therefore, it has been determined that a dealer will stand on seventeen approximately between 14.0 to 22.0 per cent of the time, on eighteen approximately 9.0 to 14.0 per cent of the time, on nineteen approximately 10.0 to 15.0 per cent of the time, on twenty approximately between 15.5 and 24.0 per cent of the time, and the dealer will score twenty one approximately 8.5 to 13.0 per cent of the time. In response to hitting a sixteen or lower, the dealer will bust approximately 21.0 to 33.0 per cent of the time.

In a specific illustrative embodiment of the invention, the dealer possibilities of twenty one, twenty, nineteen, eighteen, seventeen, and bust, are represented in a second board region which is characterized as a pie chart with respective pie-shaped segments corresponding to the various possibilities. The angular dimensions of the respective pie-shaped segments in an illustrative embodiment have respective percentages of the overall pie chart as follows:

| DEALER CARD COMBINATION VALUE | APPROXIMATE PIE CHART PERCENTAGE |
|---|---|
| 21 | 10.8 |
| 20 | 19.9 |
| 19 | 12.5 |
| 18 | 11.4 |
| 17 | 18.2 |
| Bust | 27.2 |

In the illustrative embodiment, a rotatable pointer is installed to pivot at the center of the pie chart. Thus, it can be assumed for practical purposed that the pointer will stop so as to indicate one of the permissible dealer possibilities in proportion to the size of the segment in accordance with the foregoing table.

In accordance with a method aspect of the invention, a chance device is operated to obtain a further substantially unpredictable value which advances the player along a sequence of stations on the game board. As indicated above, each such station has a respective station value associated with it. A further chance device, which may or may not be the same chance device in certain embodiments of the invention, is operated to obtain a second substantially unpredictable value. This chance device has inherent probabilities associated with respective possible values of the second substantially unpredictable value. The second substantially unpredictable value is correlated to an associated addition value which is added to the station value to obtain a playing value. Subsequently, the playing value is compared to a threshold value to determine whether the playing value is playable by the player.

A further chance device is operated to obtain a further substantially unpredictable value for a second player, which may be deemed to be the house or dealer. The further substantially unpredictable value is then compared to the threshold value so as to determine whether the further substantially unpredictable value is playable. As is the case with conventional blackjack, the threshold value is twenty one. Additionally, a winner is determined by comparing the playing value of the first player and the further substantially unpredictable value from the second player. In certain embodiments of the method invention, one or more additional players may be accommodated in the game. Such additional players may be directed to play sequentially, illustratively changing when the house or dealer wins a hand. Alternatively, all such players may play simultaneously, as in conventional blackjack.

BRIEF DESCRIPTION OF THE DRAWING

Comprehension of the invention is facilitated by reading the following detailed description in conjunction with the annexed drawing, in which.

DETAILED DESCRIPTION OF THE INVENTION

Figure 1:
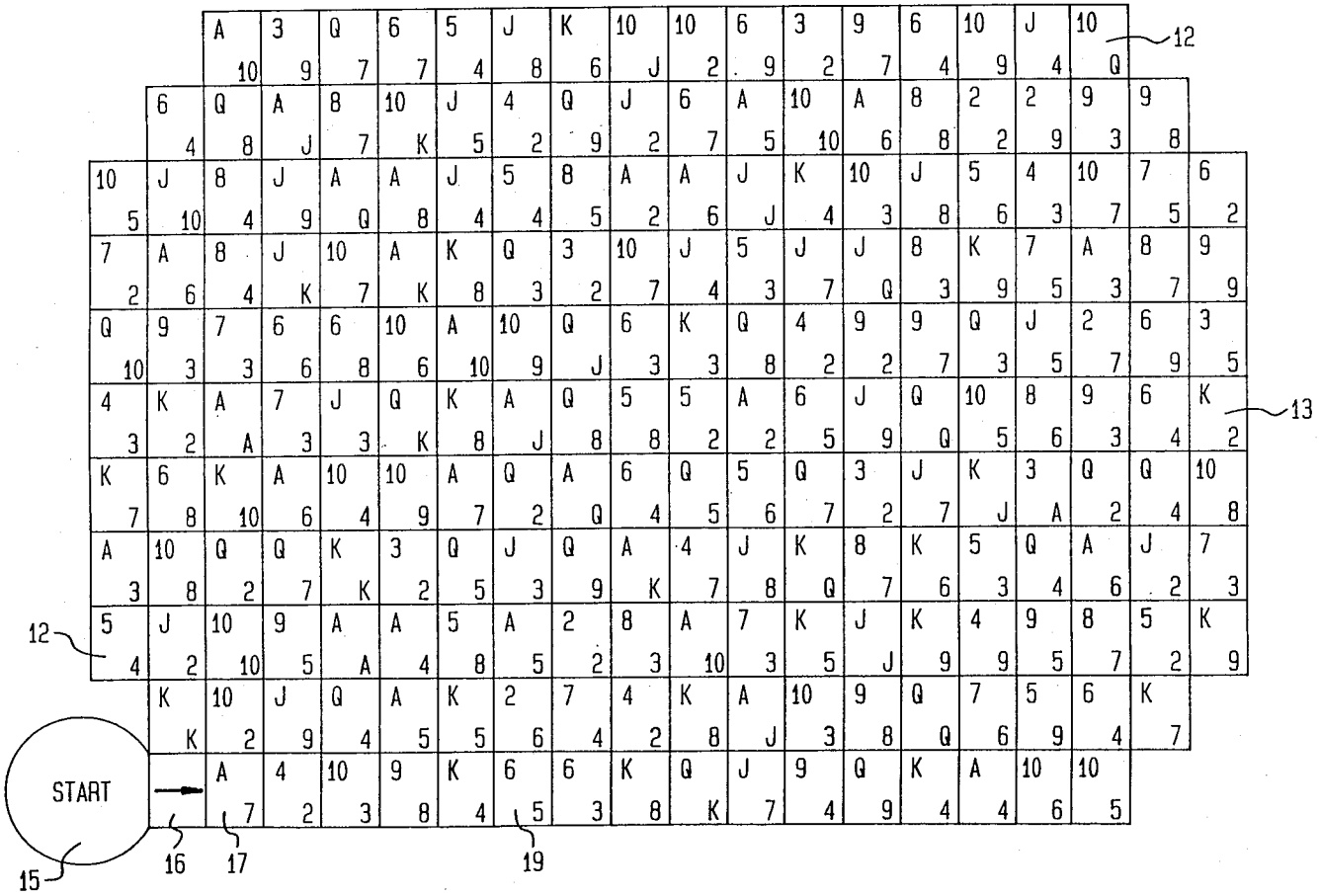
FIG. 1 is a plan view of a specific illustrative embodiment of a first game board region showing a plurality of player stations; an FIG. 2 is a representation of a specific illustrative embodiment of a second game board region showing a plurality of regions corresponding to respective dealer possibilities.

FIG. 1 is a simplified schematic representation of a specific illustrative embodiment of a game board region 10 which is organized for playing the blackjack board game of the present invention. As shown, game board region 10 is arranged to have a plurality of player stations 12 in rows and columns. Each player station 12 is designated with two values corresponding to respective playing cards in a blackjack card deck. For example, station 13 is shown to have a "K" and a "2" which indicate that this station is the equivalent of having been dealt a king and a deuce. In this specific embodiment, suits are not depicted. However, suits may be shown in other embodiments.

Game board region 10 contains 208 stations, each corresponding to the values of two playing cards. Thus, the illustrative game board region 10 is the equivalent of 208 card pairs which is the equivalent of eight decks of blackjack playing cards. Of course, many more combinations of card pairs are available in an eight deck stack, and therefore a substantial number of other game board region organizations may be provided to afford variation in the playing of the game.

For sake of illustration, a player might start at the lower left-hand corner of the game board in a start region 15. The player then rolls a chance device, such as a pair of dice (not shown) and is provided with a number which advances the player along the lowest row in a left to right direction. In an embodiment of the invention where a pair of dice is rolled to advance the player, a dummy station 16 is provided so it would be possible for a player to land on station 17, in view of the fact that a 2 is the lowest number which can be rolled with a pair of dice. Upon landing on a station, the player may elect to stand on the combination represented by the station, or the player may elect to be hit. If the player elects to be hit, the chance device, such as the pair of dice in this embodiment, are rolled again to produce a second chance number. This number is then correlated to a card value, as described above. For example, assuming a player rolls initially a seven on the pair of dice, the player is advanced from start region 15 to station 19 which has a station value of eleven. Most probably, a player landing on this station will elect to be hit, and therefore, the dice are rolled again. Assuming that the player rolls a three, it is shown in the table presented above that a dice value of three corresponds to a correlated card value of 1 or 11. The player in this situation would chose the card value of 1 because an 11 would result in a bust value of twenty two. Since the player now has a playing value of twelve, the player may elect to be hit again, and therefore the dice will be rolled again. Assuming that on this second hit, the player rolls a twelve, this correlates to a card value of eight, giving the player a playing value of twenty. Most probably, the player will stand on this value.

Figure 2:
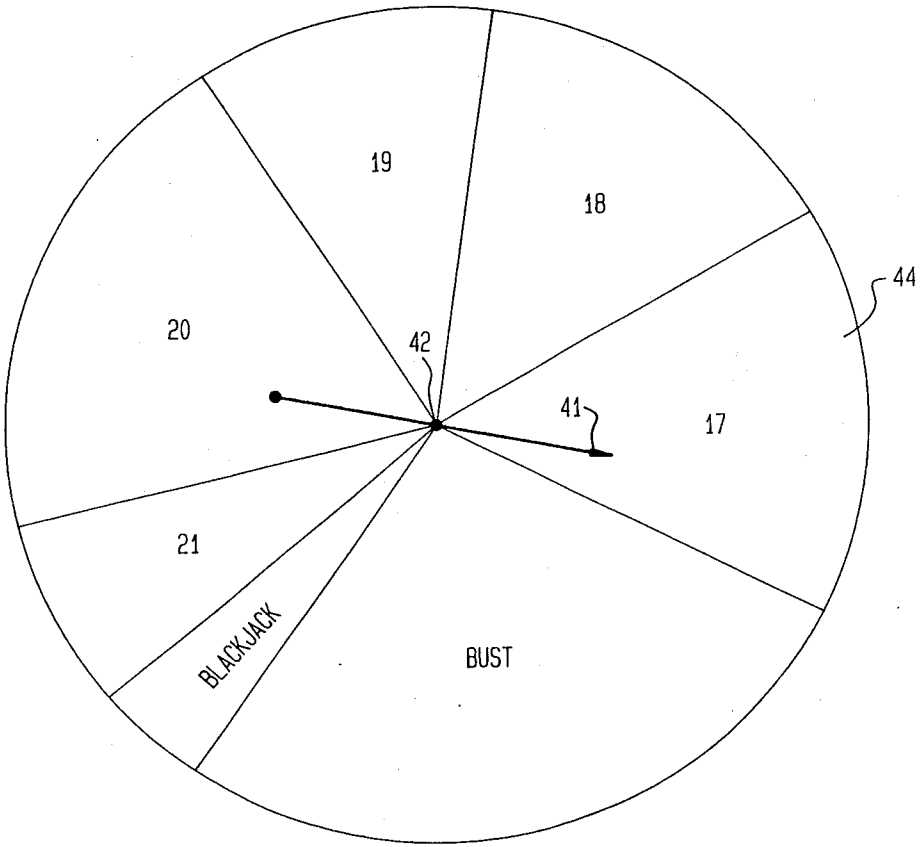

FIG. 2 shows a schematic representation of a specific illustrative embodiment of a second game board region which is configured to have a plurality of pie-shaped segments, respective ones of such segments corresponding to the possible card values which a dealer might attain. Such values are 17, 18, 19, 20, 21, and bust. However, in this embodiment, the sector corresponding to value 21 is divided so as to show a region 21 having approximately 6.9% of the total area, and a further region corresponding to blackjack, and having approximately 3.9% of the total area.

As shown in FIG. 2, a second game board region 40 has the dealer card value sectors depicted thereon, and a spinner 41 is arranged thereon to spin in a known manner. If it is assumed that the spinner, for practical purposes is ideal with only a constant friction operating at its pivot 42, then the probability that the spinner will stop to indicate any particular sector will be a function of the angular proportion of that sector with respect to the overall second game board region. In this specific illustrative embodiment, as indicated above, sector 44 which corresponds to card value 17 has an angle of approximately 65.5°, corresponding to approximately 18.2% of 360°. Thus, it is expected that the spinner would stop in this sector approximately 18.2% of the time.

Continuing with the game, since the dealer has a hand of 17, then this hand was won by the player.

It should be noted that, in the practice of the invention, two players may play against one another using only the first game board region. Alternativey, one of the players may function as a dealer using the second game board region, or multiple players can serve as a dealer for one another. Thus, several modes of blackjack play are available, for multiple players.

Although the invention has been described in terms of specific embodiments and applications, persons skilled in the art, in light of this teaching, can generate additional embodiments without exceeding the scope or departing from the spirit of the claimed invention. Accordingly, it is to be understood that the drawing and descriptions in this disclosure are proffered to facilitate comprehension of the invention and should not be construed to limit the scope thereof.

What is claimed is:

1. A game apparatus for playing a game of chance between at least first and second player entities, the game apparatus comprising:

a first game board region having thereon a plurality of stations arranged in a predetermined sequence of stations, each such station having identified thereon a combination of specified card pairs from a blackjack card deck;

a chance device for generating from a predetermined plurality of numerical values a substantially unpredictable numerical value, means for correlating said predetermined plurality of numerical values to a specific card value from a blackjack card deck such that said generated unpredictable numerical value can be correlated to a specific card value from a blackjack card deck for addition with said combination of a specified card pair of a chance-selected one of said stations to produce a sum value for the first player entity, each of said numerical values having a respective associated probability of being generated which is different from that of another of said numerical values; and a second game board region for selecting a further substantially unpredictable chance value for the second player entity, whereby said sum value and said further substantially unpredictable chance value are compared to one another for determining a winner between the first and second player entities.

2. The game apparatus of claim 1 wherein said chance device comprises a pair of dice.

3. The game apparatus of claim 2 wherein said means for correlating said predetermined plurality of numerical values to a specific card value from a blackjack deck comprises the following table:

| DICE VALUE | CORRELATED CARD VALUE |
|---|---|
| 2 | 1 or 11 |
| 3 | 1 or 11 |
| 4 | 7 |
| 5 | 5 |
| 6 | 4 |
| 7 | 10 |
| 8 | 10 |
| 9 | 9 |
| 10 | 9 |
| 11 | 2 |
| 12 | 8 |

4. The game apparatus of claim 1 wherein said second game board region comprises segmented means having a plurality of segment regions which are respectively dimensioned to correspond probabilistically with selected values of card combinations from a blackjack card deck.

5. The game apparatus of claim 4 wherein said segment regions are each dimensioned with respect to an overall dimension parameter in accordance with the following ranges:

| CARD COMBINATION VALUE | APPROXIMATE DIMENSION PROPORTION (%) RANGE |
|---|---|
| 21 | 8.5–13.0 |
| 20 | 15.5–24.0 |

-continued

| CARD COMBINATION VALUE | APPROXIMATE DIMENSION PROPORTION (%) RANGE |
|---|---|
| 19 | 10.0–15.0 |
| 18 | 9.0–14.0 |
| 17 | 14.0–22.0 |

6. The game apparatus of claim 5 wherein a card combination value corresponding to a loss is correlated to a segment region having an Approximate Dimension Proportion of between approximately 21.0% and 33.0% with respect to said overall dimension parameter.

7. The game apparatus of claim 4 wherein said segmented means comprises:

a radially-divided member having substantially radial segments identified thereon corresponding to said segment regions; and indicator means for indicating one of said substantially radial segments.

* * * * *